United States Patent [19]

Williams

[11] Patent Number: 4,940,160

[45] Date of Patent: Jul. 10, 1990

[54] NEWSPAPER VENDING MACHINE AND PROMOTIONAL DISPLAY APPARATUS THEREFOR

[75] Inventor: Ronald E. Williams, Moscow, Id.

[73] Assignee: Tribune Publishing Company, Lewiston, Id.

[21] Appl. No.: 290,502

[22] Filed: Dec. 27, 1988

[51] Int. Cl.[5] ..... G07F 11/04

[52] U.S. Cl. ..... 221/34; 194/350; 221/59; 221/155; 40/313

[58] Field of Search ..... 221/34, 45, 46, 58, 221/59, 60, 92, 155, 199, 281; 194/350; 40/312, 313; 312/60, 61, 118, 120, 123

[56] References Cited

U.S. PATENT DOCUMENTS

| | | | |
|---|---|---|---|
| 499,247 | 6/1893 | Raisbeck . | |
| 1,414,682 | 5/1922 | Zautner | 40/313 X |
| 1,932,890 | 10/1933 | Grondahl | 40/20 |
| 2,110,128 | 3/1938 | Kent | 312/112 |
| 2,426,707 | 9/1947 | Polsen et al. | 221/281 X |
| 2,467,411 | 4/1949 | Tingdale | 40/7 |
| 2,469,369 | 5/1949 | Clark | 40/105 |
| 2,644,259 | 7/1953 | Beadle | 40/312 |
| 2,791,049 | 5/1957 | Berger et al. | 40/125 |
| 2,845,729 | 8/1958 | Baumgart | 40/10 |
| 3,005,277 | 10/1961 | Sherron | 40/125 |
| 3,268,281 | 8/1966 | Szerszen | 312/198 |
| 3,803,738 | 4/1974 | Weiss | 40/306 |
| 4,131,213 | 12/1978 | Tamura et al. | 221/155 X |
| 4,506,776 | 3/1985 | Voegeli | 194/350 |

*Primary Examiner*—F. J. Bartuska

*Attorney, Agent, or Firm*—Wells, St. John & Roberts

[57] ABSTRACT

A promotional display apparatus for a newspaper vending machine, and a newspaper vending machine incorporating a promotional display apparatus, are disclosed. The display apparatus comprises a fixture securable to the newspaper vending machine door. The fixture includes a display section for displaying promotional information. The display section in operation projects internally away from the inside of the vending machine door and into the vending machine internal cavity elevationally above a stack of newspapers therein when the vending machine door is closed. The display section in operation effectively displays promotional information to the vending machine user when the vending machine door is swung away from the housing.

20 Claims, 6 Drawing Sheets

10

3
14
38
24
22
34
12
42
68
68
42
68
68
32
30
20
28
18
36
36
36
3

16
38
34
26
10
22
28
32
12
40
44
14
18
68
42
68
30
68
20
18a
18
18

NEWSPAPER VENDING MACHINE AND PROMOTIONAL DISPLAY APPARATUS THEREFOR

TECHNICAL FIELD

This invention relates to advertising or other promotional displays for newspaper vending machines.

BACKGROUND OF THE INVENTION

Two popular methods of marketing newspapers are by door-to-door delivery and through newspaper vending machines. It is generally more profitable for a newspaper publisher to sell newspapers through delivery subscriptions, as opposed to sales through vending machines.

One method of offering home delivery subscriptions to those that purchase newspapers through vending machines is to occasionally insert subscription offers inside of newspapers that will be stacked in vending machines. It is the constant quest of newspaper circulation managers to make subscription offers available as often as possible for less money to the people most likely to take advantage of such offers.

This invention is primarily directed to a new product designed to help newspaper companies sell home delivery subscriptions to individuals who buy newspapers from vending machines. It might also be useful in providing other promotional information to those who purchase newspapers from newspaper vending machines.

BRIEF DESCRIPTION OF THE DRAWINGS

Preferred embodiments of the invention are illustrated in the accompanying drawings, in which:

FIG. 6 is a cross sectional view taken along line 6—6 in FIG. 5.

DETAILED DESCRIPTION OF THE PREFERRED EMBODIMENT

Figure 1:
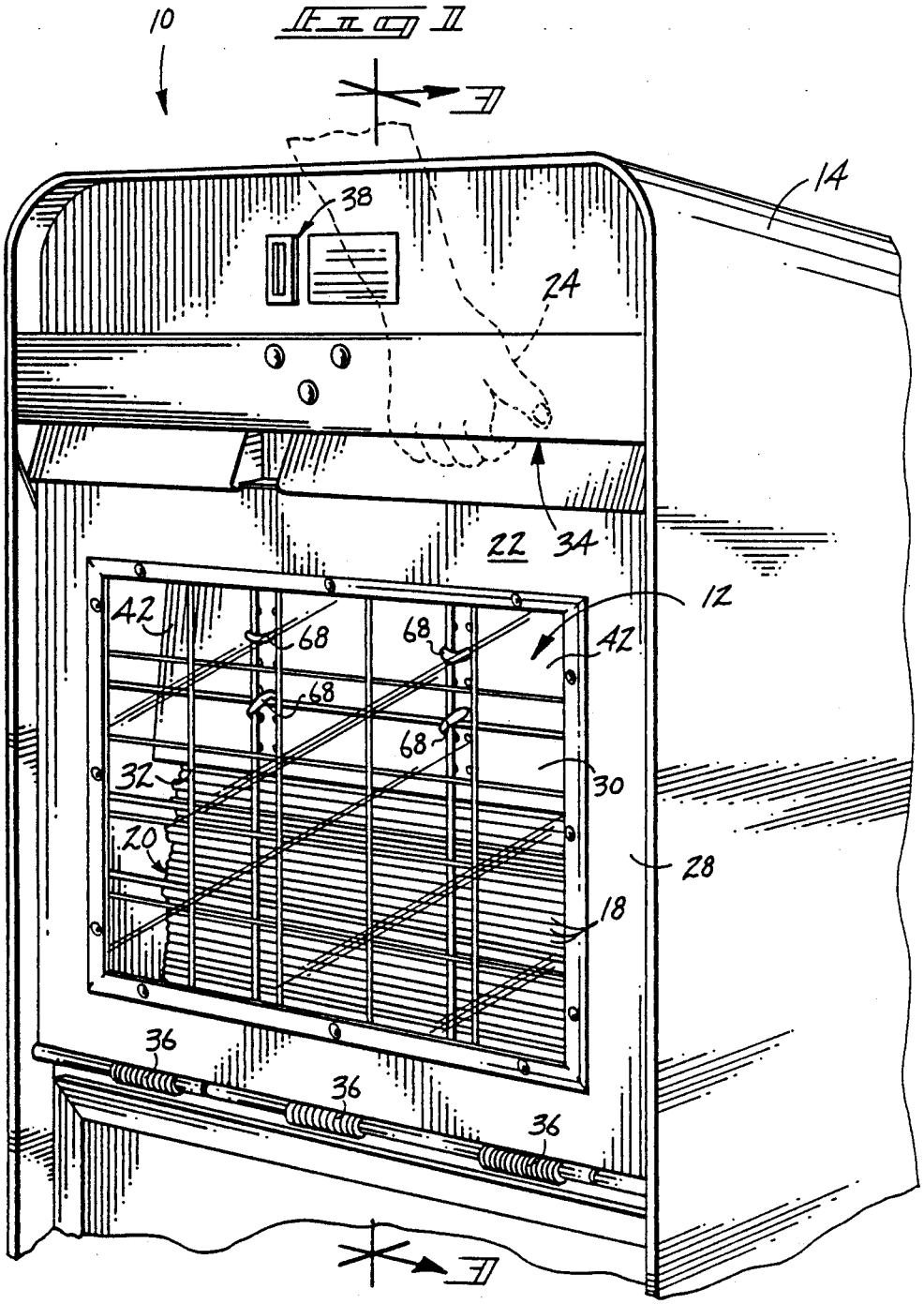
FIG. 1 is a perspective view of a newspaper vending machine having a promotional display apparatus secured thereto in accordance with one aspect of the invention.

The following disclosure of the invention is submitted in compliance with the constitutional purpose of the Patent Laws "to promote the progress of science and useful arts" (Article 1, Section 8).

Referring to the figures, a newspaper vending machine and a promotional display apparatus for a newspaper vending machine are indicated generally by reference numerals 10, 12, respectively. The display apparatus effectively displays promotional information (such as newspaper subscription information) to the user or customer when the vending machine door is swung into the open position.

More particularly, newspaper vending machine 10 comprises a housing 14 which defines an internal cavity 16 for retaining individual folded newspapers 18 in a stack 20. The front of housing 14 includes a pivotally mounted door 22 which is swingable away from housing 14 when unlocked and pulled upon by a user 24. This provides access to the user to a newspaper 18 in stack 20 within housing cavity 16.

Door 22 includes an internally facing door portion 26 which faces into housing cavity 16, and an outwardly facing door portion 28, which faces externally away from housing 14. Door 22 includes a door window 30 which is slightly larger than the size of folded newspaper 18.

Figure 3:
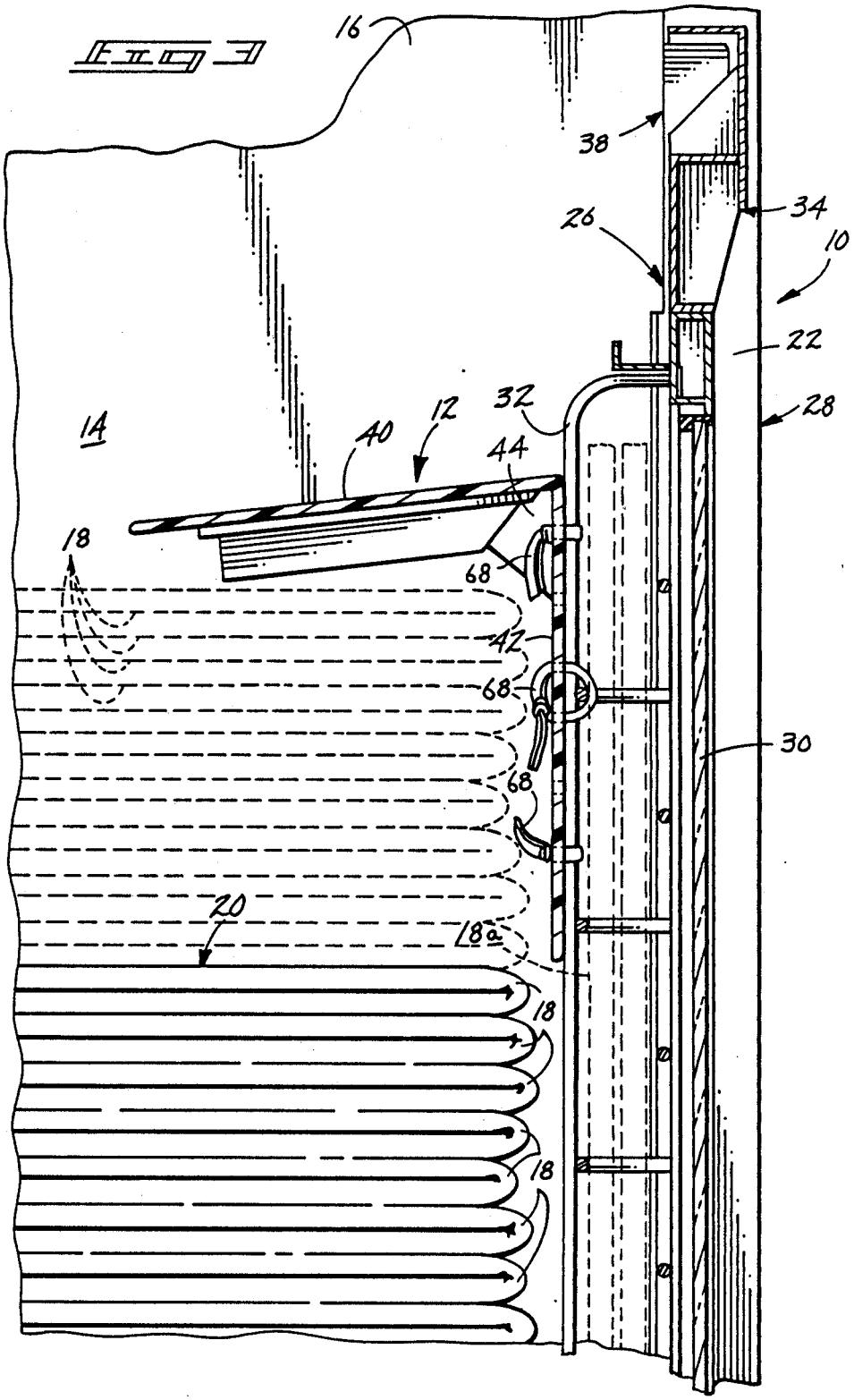
FIG. 3 is an enlarged cross-sectional view taken along line 3—3 in FIG. 1.

A newspaper display rack 32 is mounted relative to inside door portion 26 and overlies door window 30 to receive and display a newspaper **18*a* received thereby through window 30 to a user. FIG. 3 illustrates a folded newspaper 18A in phantom mounted within the rack 32 to be visible to a potential purchaser. Outwardly facing door portion 28 includes a recessed handle 34 to facilitate the opening of door 22. Door 22 is spring biased by springs 36 to a normally closed and locked state, as illustrated in FIGS. 1 and 3. The preferred materials of construction for vending machine 10 are metal, with door window 30** being of a suitable transparent glass or plastic material.

A conventional money receiving and locking mechanism, indicated generally by reference numeral 38, is also provided in door 22. Mechanism 38 receives a user's money and unlocks door 22 so it can be swung away from housing 14 to make a newspaper 18 within housing cavity 16 accessible to the user. Subsequent closure of door 22 locks it relative to housing 14 where it can be again unlocked by insertion of more money.

Promotional display apparatus 12 comprises a fixture which is securable relative to vending machine door 22. Attachment means are provided for securing the fixture to door 22. More particularly, apparatus 12 includes a fixture display section or face 40 for displaying promotional information, and a fixture triangular end gussets 44 are provided for strength, and support display section 40 relative to mounting section 42. Each of sections 40, 42, and gussets 44 are generally thin and flat. Apparatus 12 would typically be constructed of any suitable hard plastic material. It is elongated having a length approximating that of window 30 and is securable relative to inside door portion 26 as will be more fully described below.

Figure 2:
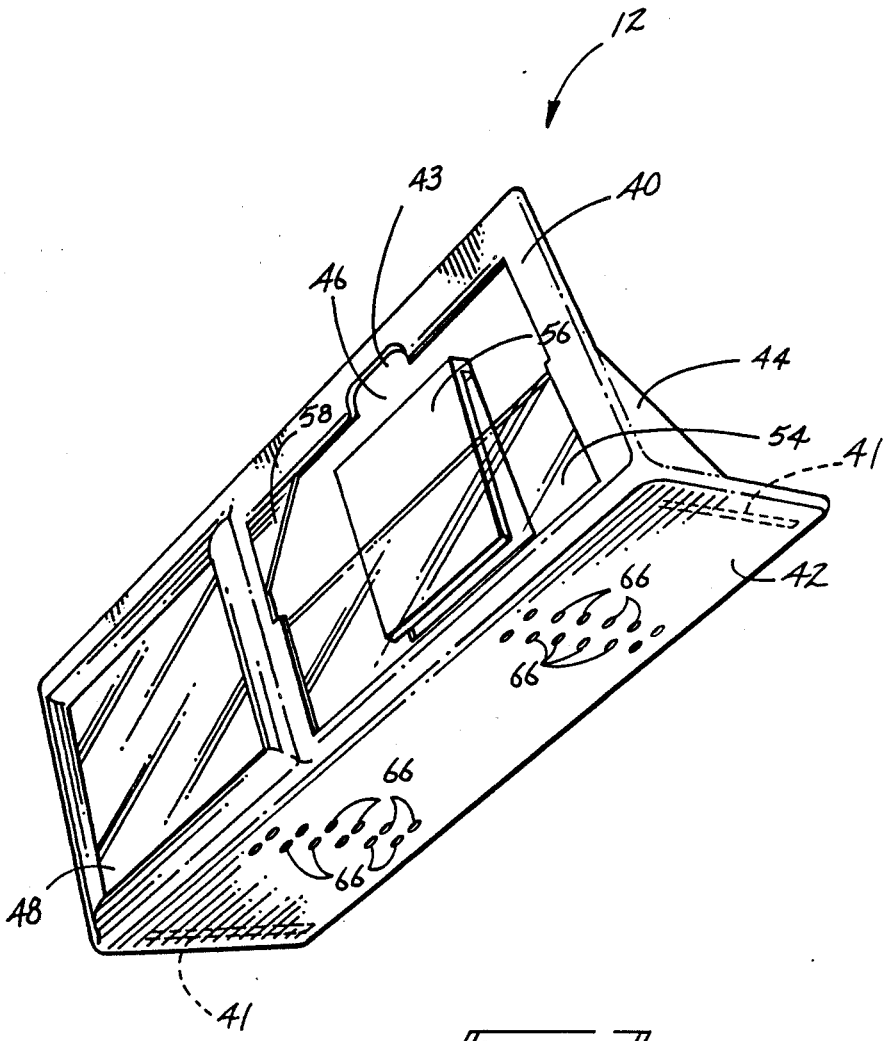
FIG. 2 is an enlarged perspective view of the promotional display apparatus illustrated in FIG. 1.
Figure 4:
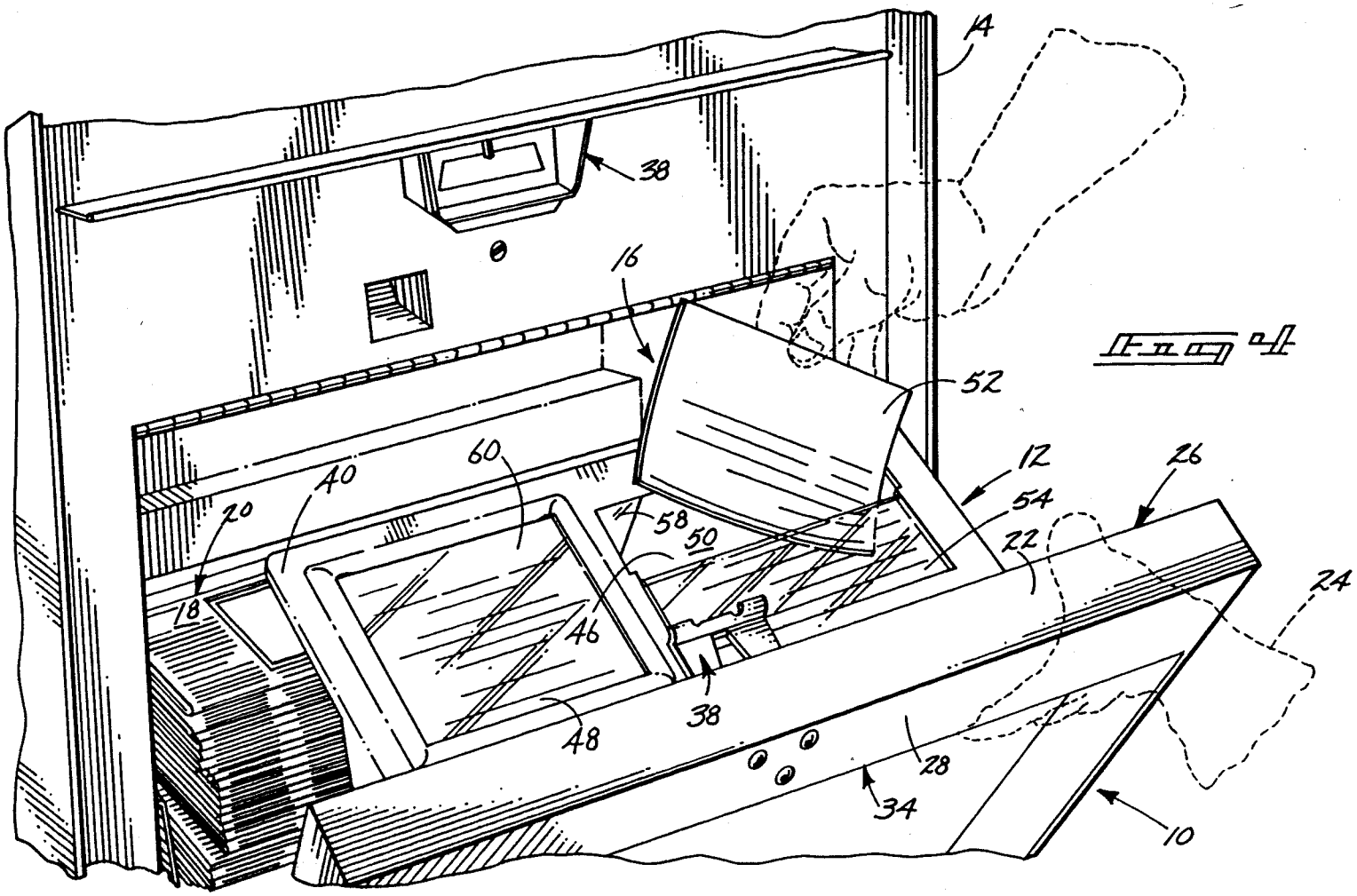
FIG. 4 is a fragmentary perspective view of the newspaper vending machine of FIG. 2 illustrating the vending machine door in an open position.
Figure 5:
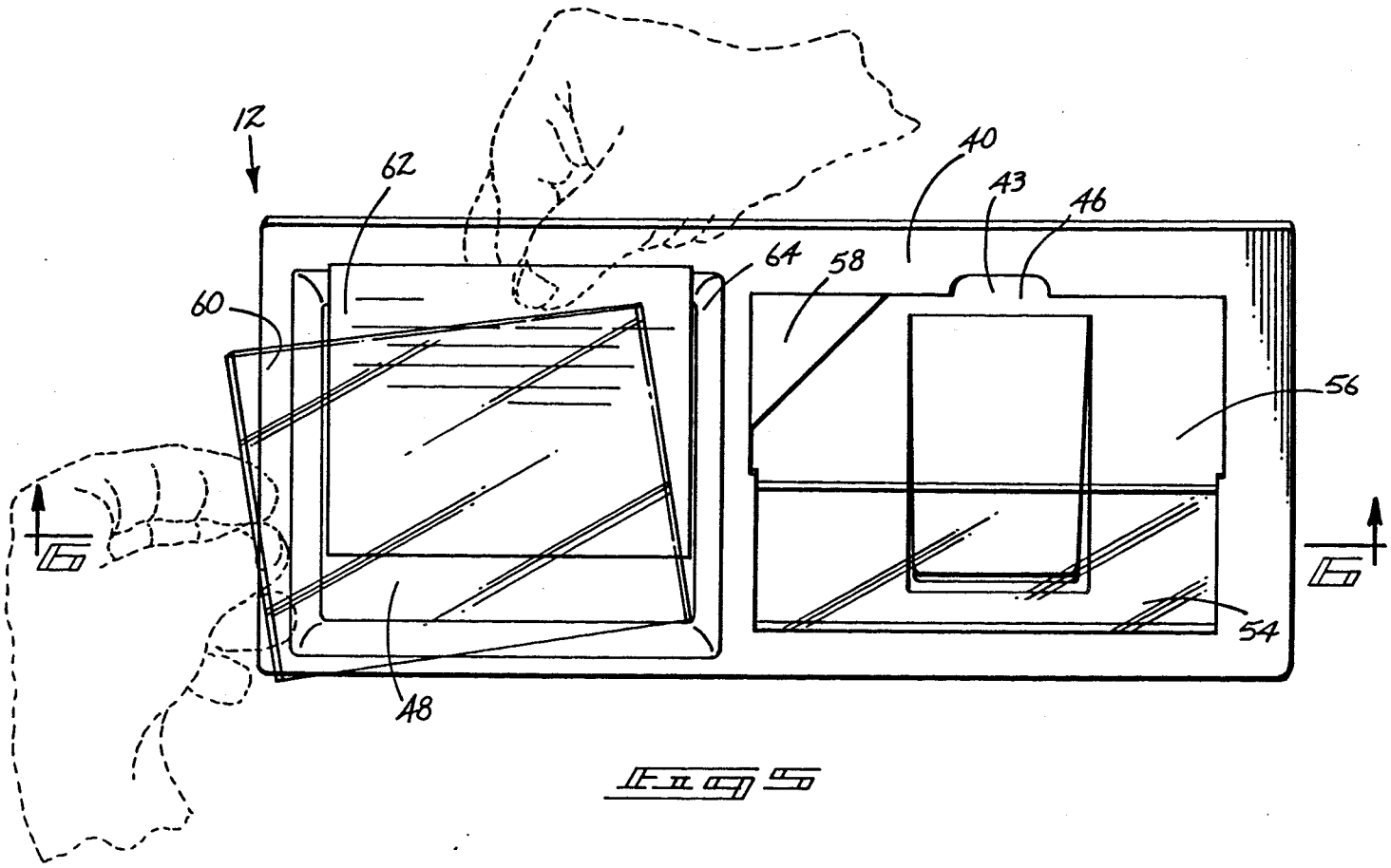
FIG. 5 is a side elevational view of the apparatus of FIG. 1 illustrating operational aspects of the apparatus.
Figure 16:
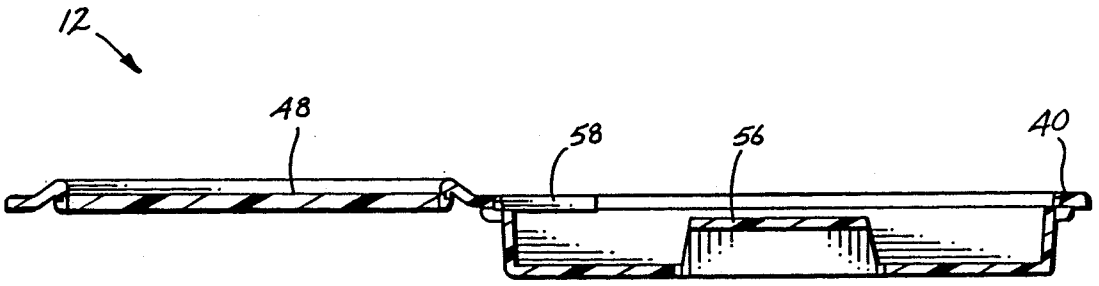

The outwardly facing surface of display section 40 includes a rectangular pocket or open receptacle 46, and an adjacent closed rectangular windowed display receptacle 48. Open receptacle 46 includes a removable front facing transparent panel 54 which covers the approximate lower one-half of receptacle 46. Panel 54 is retained by slots formed in the side of the receptacle 46. Open receptacle 46 is adapted for retaining a stack 50 of individually removable forms 52 (FIG. 4). A springed or outwardly bent piece of plastic 56 is received within receptacle 46 (FIGS. 2 and 5). Piece 56 functions as a biasing member which in operation biases stack 50 of forms 52 against panel 54. This facilitates easy access to and removal of individual forms. A small triangular clear plastic retainer 58 is included in the upper left hand corner of receptacle 46 to facilitate retaining forms 52 within receptacle 46 as well as easy removal of such forms. A recessed finger or thumb slot 43 is provided atop receptacle 46 to facilitate removal of forms which are retained in receptacle 46.

Windowed receptacle 48 is preferably closed and adapted for retaining and displaying a sheet 62 of promotional display material that would not be generally intended to be removed by the vending machine user. Sheet 62, for example, might be printed with information emphasizing advantages of newspaper delivery. Receptacle 48 includes a removable transparent receptacle window 60 to enable interchange of one sheet 62 of promotional display material with another sheet. A window retaining frame 64 is integrally molded as part of apparatus 12 for retaining window 60 relative to receptacle 48. Window 60 is constructed of a suitable flexible plastic that could be bent slightly for easy insertion and removal relative to retaining frame 64.

Mounting section 42 of display apparatus 12 is preferably configured to be securable relative to the upper portion of newspaper display rack 32 on internal door portion 26. To accommodate such mounting, mounting section 42 includes two spaced columns of a plurality of pairs of holes 66 extending therethrough. The two columns of holes 66 correspond in position to align with vertical support portions of rack 32 (FIG. 1). A plurality of clamping devices 68 in operation extend through pairs of holes 66 and around portions of newspaper display rack 32 to secure fixture apparatus 12 securely relative thereto. In the illustrated and preferred embodiment, clamping devices 68 are in the form of one-way flexible plastic clamps, commonly referred to as tiger-clips. Reinforcing ribs 41 are also provided on the internal portion of mounting section 42 for strength.

With promotional display apparatus 12 secured as illustrated in FIGS. 2–4, display section 40 in operation projects internally away from inside door portion 26. Display section 40 in operation projects into housing cavity 16 elevationally above stack 20 of folded newspapers 18 when door 22 is closed (FIGS. 1 and 3). When door 22 is unlocked and swung open by a user (FIG. 4), display section 40 effectively displays promotional information thereon to the user. The apparatus 12 has a width sufficient to accommodate a high stack of newspapers whereby the apparatus sidewalls 44 extend along the sides of the newspapers, the mounting section faces the front edge of the upper newspaper, and the display section extends immediately over the uppermost newspaper in the stack.

Display section 40 is preferably used as follows. Closed window receptacle 48 is provided with a sheet of advertising material disclosing the benefits of home or door delivery of newspapers, and inviting the vending machine user to make such a subscription. Open receptacle 46 retains a stack of individually removable newspaper subscription forms which the user could remove, complete, and send to the newspaper for subscribing to home delivery. Alternate promotional material could also be presented by apparatus 12 without departing from the principles and scope of the invention.

In the illustrated and preferred embodiment, promotional display apparatus 12 is a separate fixture which is removably securable relative to vending machine door 22. Apparatus 12 might alternatively be integrally constructed as part of display rack 32 or vending machine door 22.

In compliance with the statute, the invention has been described in language more or less specific as to structural features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. For a newspaper vending machine defined by at least, (a) a housing having an internal cavity which retains newspaper in a stack, (b) a spring loaded and locked door which is pivotally mounted to the housing and swings away from the housing when unlocked and pulled upon by a user to enable access to newspapers within the housing cavity, the door having an inside door portion which faces internally into the housing cavity, the door having an outside door portion which faces externally away from the housing, the outside door portion having a handle for a user to grasp, the door being spring biased to a normally closed and locked state, and (c) a money receiving and locking mechanism to receive a user's money and unlock the door so it can be swung away from the housing to make a newspaper within the housing cavity accessible to the user, a promotional display apparatus comprising:

a fixture securable to the inside door portion of the newspaper vending machine door;

attachment means for securing the fixture to the inside door portion of the newspaper vending machine door; and the fixture including a display section for displaying promotional information, the display section in operation projecting internally away from the inside door portion, the display section in operation projecting into the housing cavity elevationally overlying a stack of newspapers therein when the newspaper vending machine door is closed, the display section in operation effectively displaying the promotional information to the user when the newspaper vending machine door is swung away from the housing.

2. The promotional display apparatus of claim 1 wherein the display section includes an open receptacle for retaining a stack of removable forms.

3. The promotional display apparatus of claim 2 wherein the open receptacle includes a front facing panel and a biasing member, the biasing member in operation biasing the stack of removable forms against the front facing panel of the open receptacle to facilitate easy removal of individual forms.

4. The promotional display apparatus of claim 3 wherein the front facing panel of the open receptacle is transparent.

5. The promotional display apparatus of claim 1 wherein the display section includes a windowed receptacle for retaining and displaying a sheet of promotional display material, the windowed receptacle including a transparent receptacle window which is removably secured relative to the display section to enable interchange of one sheet of promotional display material with another.

6. The promotional display apparatus of claim 5 wherein the display section includes an open receptacle for retaining a stack of removable forms, the open receptacle being positioned adjacent the windowed receptacle.

7. The promotional display apparatus of claim 6 wherein the open receptacle includes a front facing panel and a biasing member, the biasing member in operation biasing the stack of removable forms against the front facing panel of the open receptacle to facilitate easy removal of individual forms.

8. The promotional display apparatus of claim 1 wherein the attachment means comprises a fixture mounting section which is angled from the display section, the attachment means further including means for securing the mounting section relative to the inside door portion of the newspaper vending machine.

9. The promotional display apparatus of claim 1 wherein the vending machine door has a door window and a newspaper display rack, the newspaper display rack being mounted relative to the inside door portion over the door window to display a newspaper received thereby through the door window to a user;

the attachment means of the promotional display apparatus including means for securing the mounting section to the newspaper display rack.

10. The promotional display apparatus of claim 9 wherein the means for securing the mounting section to the newspaper display rack comprises:

the mounting section including a plurality of holes extending therethrough; and a plurality of clamping devices which in operation extend through pairs of the holes and around portions of the newspaper display rack.

11. The promotional display apparatus of claim 9 wherein the display section includes an open receptacle for retaining a stack of removable forms.

12. The promotional display apparatus of claim 11 wherein the open receptacle includes a front facing panel and a biasing member, the biasing member in operation biasing the stack of removable forms against the front facing panel of the open receptacle to facilitate easy removal of individual forms.

13. The promotional display apparatus of claim 9 wherein the display section includes a windowed receptacle for retaining and displaying a sheet of promotional display material, the windowed receptacle including a transparent receptacle window which is removably secured relative to the display section to enable interchange of one sheet of promotional display material with another.

14. The promotional display apparatus of claim 13 wherein the display section includes an open receptacle for retaining a stack of removable forms, the open receptacle being positioned adjacent the windowed receptacle.

15. The promotional display apparatus of claim 14 wherein the open receptacle includes a front facing panel and a biasing member, the biasing member in operation biasing the stack of removable forms against the front facing panel of the open receptacle to facilitate easy removal of individual forms.

16. A newspaper vending machine comprising:

a housing having an internal cavity which retains newspapers in a stack;

a spring loaded and locked door which is pivotally mounted to the housing and swings away from the housing when unlocked and pulled upon by a user to enable access to newspapers within the housing cavity, the door having an inside door portion which faces internally into the housing cavity, the door having an outside door portion which faces externally away from the housing, the outside door portion having a handle for a user to grasp, the door being spring biased to a normally closed and locked state;

a money receiving and locking mechanism to receive a users money and unlock the door so it can be swung away from the housing to make a newspaper within the housing cavity accessible to the user;

a promotional display apparatus extending from the newspaper vending machine door, the promotional display apparatus including a display section for displaying promotional information, the display section projecting internally away from the inside door portion, the display section projecting into the housing cavity elevationally above and over a stack of newspapers therein when the newspaper vending machine door is closed, the display section in operation effectively displaying the promotional information to the user when the newspaper vending machine door is swung away from the housing.

17. The newspaper vending machine of claim 16 wherein the display section includes an open receptacle for retaining a stack of removable forms.

18. The newspaper vending machine of claim 16 wherein the display section includes a windowed receptacle for retaining and displaying a sheet of promotional display material, the windowed receptacle including a transparent receptacle window which is removably secured relative to the display section to enable interchange of one sheet of promotional display material with another.

19. The newspaper vending machine of claim 18 wherein the display section includes an open receptacle for retaining a stack of removable forms, the open receptacle being positioned adjacent the windowed receptacle.

20. The newspaper vending machine of claim 16 wherein, the vending machine door has a door window and a newspaper display rack, the newspaper display rack being mounted to the inside door portion over the door window to display a newspaper received thereby through the door window to a user; and the promotional display apparatus being secured to the newspaper display rack.

* * * * *